US006902384B2

(12) United States Patent
Kropat et al.

(10) Patent No.: US 6,902,384 B2
(45) **Date of Patent: *Jun. 7, 2005**

(54) APPARATUS FOR MELT SPINNING AND COOLING A GROUP OF FILAMENTS

(75) Inventors: Horst Kropat, Warmsdorfstrasse (DE); Andreas Cohrt, Schulstrasse (DE)

(73) Assignee: Neumag GmbH & Co. KG, Neumunster (DE)

( * ) Notice: Subject to any disclaimer, the term of this patent is extended or adjusted under 35 U.S.C. 154(b) by 175 days.

This patent is subject to a terminal disclaimer.

(21) Appl. No.: 10/216,463

(22) Filed: Aug. 8, 2002

(65) Prior Publication Data

US 2003/0039710 A1 Feb. 27, 2003

(30) Foreign Application Priority Data

Aug. 25, 2001 (DE) ..... 101 41 670

(51) Int. Cl.[7] ..... D01D 5/096

(52) U.S. Cl. ..... 425/72.2; 425/94; 425/104; 425/136; 425/150; 425/171; 425/192 S; 425/DIG. 19

(58) Field of Search ..... 425/72.2, 464, 425/90, 94, 104, 192 S, 382.2, 136, 150, 171, DIG. 19

(56) References Cited

U.S. PATENT DOCUMENTS

2002/0119210 A1 * 8/2002 Maas et al. ..... 425/72.2
2003/0025239 A1 * 2/2003 Brandt et al. ..... 264/211.14

FOREIGN PATENT DOCUMENTS

| | | | |
|---|---|---|---|
| DE | 36 29 731 | A1 | 9/1986 |
| EP | 0050483 | A1 | 4/1982 |
| JP | 03241003 | * | 10/1991 |

OTHER PUBLICATIONS

Patent Abstracts of Japan, Oct. 28, 1991, No. 29, vol. 16, Japan.

* cited by examiner

*Primary Examiner*—Benjamin L. Utech
*Assistant Examiner*—Joseph S. Del Sole
(74) *Attorney, Agent, or Firm*—Smith Moore LLP

(57) ABSTRACT

An apparatus for melt spinning and cooling a group of filaments comprising a spinning device with an annular spinneret and a cooling device arranged below the spinning device. The cooling device comprises a holder that is connected to a coolant dispersing head. The coolant dispersing head is centered relative to the spinneret with contact between the spinning device and the holder in an operating position. The coolant dispersing head can be guided into a standby position at a distance from the spinneret. A guide tube encloses the coolant dispersing head in the manner of a jacket with a clearance and which is open at its end facing toward the spinning device. The guide tube and coolant dispersing head are displaceable relative to one another in axial direction to produce an air stream at the blowing end of the guide tube during transition from the standby position to the operating position.

13 Claims, 3 Drawing Sheets

APPARATUS FOR MELT SPINNING AND COOLING A GROUP OF FILAMENTS

BACKGROUND OF THE INVENTION

The present invention relates to an apparatus for melt spinning and cooling a group of filaments.

When synthetic threads are melt-spun from a polymer melt using a spinneret with a plurality of nozzle bores, a plurality of strand-like filaments is extruded. The filament strands coming out of the spinnerets must be cooled before being taken up in the form of threads or thread bundles after further treatment. The cooling agent used is preferably air, which flows perpendicularly to the thread direction and is trained onto the filaments. The cooling air can penetrate the group of filaments from the exterior toward the interior or from the interior toward the exterior. German Laid Open Publication DE 36 29 731 A1, for example, discloses a prior-art device in which the cooling air stream penetrates a group of filaments from the interior toward the exterior as disclosed.

In the prior-art device the group of filaments is produced by an annular spinneret of a spinning device. A cooling device is provided below the spinning device and comprises a coolant dispersing head that is substantially centered relative to the spinneret. This coolant dispersing head is connected with a holder through which a cooling medium is introduced into the interior of the coolant dispersing head. The coolant dispersing head has a porous shell that is made, for instance, of a sintered material, such that the cooling air flowing into the interior of the coolant dispersing head exits radially therefrom and permeates the group of filaments. In this type of device, the coolant dispersing head can be displaced between an operating position and a standby position to permit startup of spinning the group of filaments at the beginning of the process. In standby position, the coolant dispersing head is guided completely out of the spinning area at a distance from the spinneret, such that particularly prolonged downtimes are inevitable if the process is interrupted. To enable the coolant dispersing head to be guided into its operating position after spinning startup, a strong radial air stream is produced at the free end of the coolant dispersing head by means of an additional annular gap that is formed at the end of the coolant dispersing head. Particularly when the coolant dispersing head is swiveled, a problem occurs wherein the filament strands that are blown away by the coolant dispersing head stick together. Another drawback is that an additional air stream must be guided to the annular gap by additional guiding means within the cooling dispersing head. When the operating position is reached, this additional air stream must be shut off by additional means.

Thus, there is a need in the art to equip an apparatus of the initially described type with a flexible cooling device, which enables the coolant dispersing head to be rapidly brought into its operating position after spinning startup without an additional supply of air.

BRIEF SUMMARY OF THE INVENTION

The present invention achieves this object by providing a guide tube that encloses the coolant dispersing head in the form of a jacket leaving a clearance. The guide tube is open at its end facing toward the spinning device (blowing end). The guide tube and the coolant dispersing head can be axially displaced relative to one another to produce an air stream at the blowing end of the guide tube.

The present invention is characterized in that the cooling air stream that radially exits through the coolant dispersing head can be used to keep the filaments away from the coolant dispersing head while the coolant dispersing head is brought into its operating position. The intensity of the air stream at the blowing end of the guide tube can be adjusted by the degree of overlap between the guide tube and the coolant dispersing head. If the guide tube extends over the entire length of the coolant dispersing head, an air stream that is oriented substantially in axial direction is produced by the guide tube at the end of the coolant dispersing head. This air stream is trained onto the spinning device such that the path for adjusting the coolant dispersing head is kept free. Since the coolant dispersing head and the guide tube can be axially displaced relative to one another, this overlap between the guide tube and the coolant dispersing head can be canceled in the operating position, such that the radial cooling air stream produced by the coolant dispersing head can exit freely to cool the filament strands.

An especially advantageous further development of the present invention makes it possible to adjust the overlap between the guide tube and the coolant dispersing head solely by moving the coolant dispersing head. To this end, the guide tube is fixed to the holder. Within the guide tube, the coolant dispersing head can be axially moved relative to the holder and relative to the guide tube between the operating position and the standby position. The overlap required to generate the air stream is thus greatest in the standby position of the coolant dispersing head and becomes smaller as the coolant dispersing head is adjusted in the direction toward the operating position. This further development has the advantage that as the overlap decreases between the coolant dispersing head and the guide tube, the air stream exiting from the blowing end of the guide tube converges with the air stream of the coolant dispersing head exiting radially outside the guide tube to form a combined air stream, so that the filament curtain flares out due to this combined air stream.

The advantageous further development of the present invention offers a particularly flexible cooling device in which the degree of overlap at the coolant dispersing head can be adjusted independently of the position of the coolant dispersing head. For this purpose, the guide tube is designed to be axially movable on the holder.

To enable a flaring out of the annular filament curtain after spinning startup, a preferred further development of the present invention proposes to provide the free end of the coolant dispersing head with a centering shoulder, which has a circumferential collar that protrudes over the diameter of the coolant dispersing head. This causes the air stream flowing out of the blowing end of the guide tube parallel to the coolant dispersing head to be deflected in radial direction. In addition, the collar of the centering shoulder can be configured in such a way that an annular air gap is produced between the blowing end and the collar.

To obtain the strongest possible axially directed air stream at the blowing end of the guide tube, an advantageous further development of the present invention provides that the end of the coolant dispersing head facing away from the holder be connected with a connecting piece that is guided in the guide tube so as to form a seal.

To increase the air stream exiting from the blowing end of the guide tube, the inventive apparatus is advantageously configured such that the air stream reaches the guide tube from the pressure chamber through a plurality of lateral openings of the guide tube and is guided between the coolant dispersing head and the guide tube toward the blowing end.

In a particularly advantageous further development of the present invention, the coolant dispersing head is axially adjustable relative to the holder between the operating position and the standby position by means of an actuator. In the operating position, the coolant dispersing head is held to the spinning device by the actuator. This ensures that the coolant dispersing head is securely guided and held in its operating position after each replacement.

This actuator can be formed by electric, pneumatic or hydraulic means.

To exchange the coolant dispersing head directly from the cooling device positioned below the spinning device, the coolant dispersing head is detachably connected with the holder according to an advantageous further development of the present invention. Thus, the coolant dispersing head is removed from the holder in standby position and after cleaning or exchange is reinstalled on the holder. The holder with the feed lines for the coolant can advantageously be kept stationary.

The holder of the cooling device is preferably used to receive a finishing device, which is mounted to the holder below the coolant dispersing head. This finishing device comprises a finishing ring, which is contacted by the group of filaments and applies a finishing agent to the filaments.

To obtain uniform wetting and distribution of the finishing agent along the surface of the finishing ring on the one hand and to ensure low wear and secure thread guidance on the other hand, the finishing ring is preferably formed by several ceramic disks.

The further development of the present invention wherein the holder is pivotable relative to the spinning device is particularly advantageous to allow the cooling device to be guided completely out of the spinning line.

BRIEF DESCRIPTION OF THE FIGURES

Some exemplary embodiments of the device according to the invention will now be described in greater detail with reference to the attached drawings in which.

DETAILED DESCRIPTION OF THE PREFERRED EMBODIMENTS

Figure 1A:
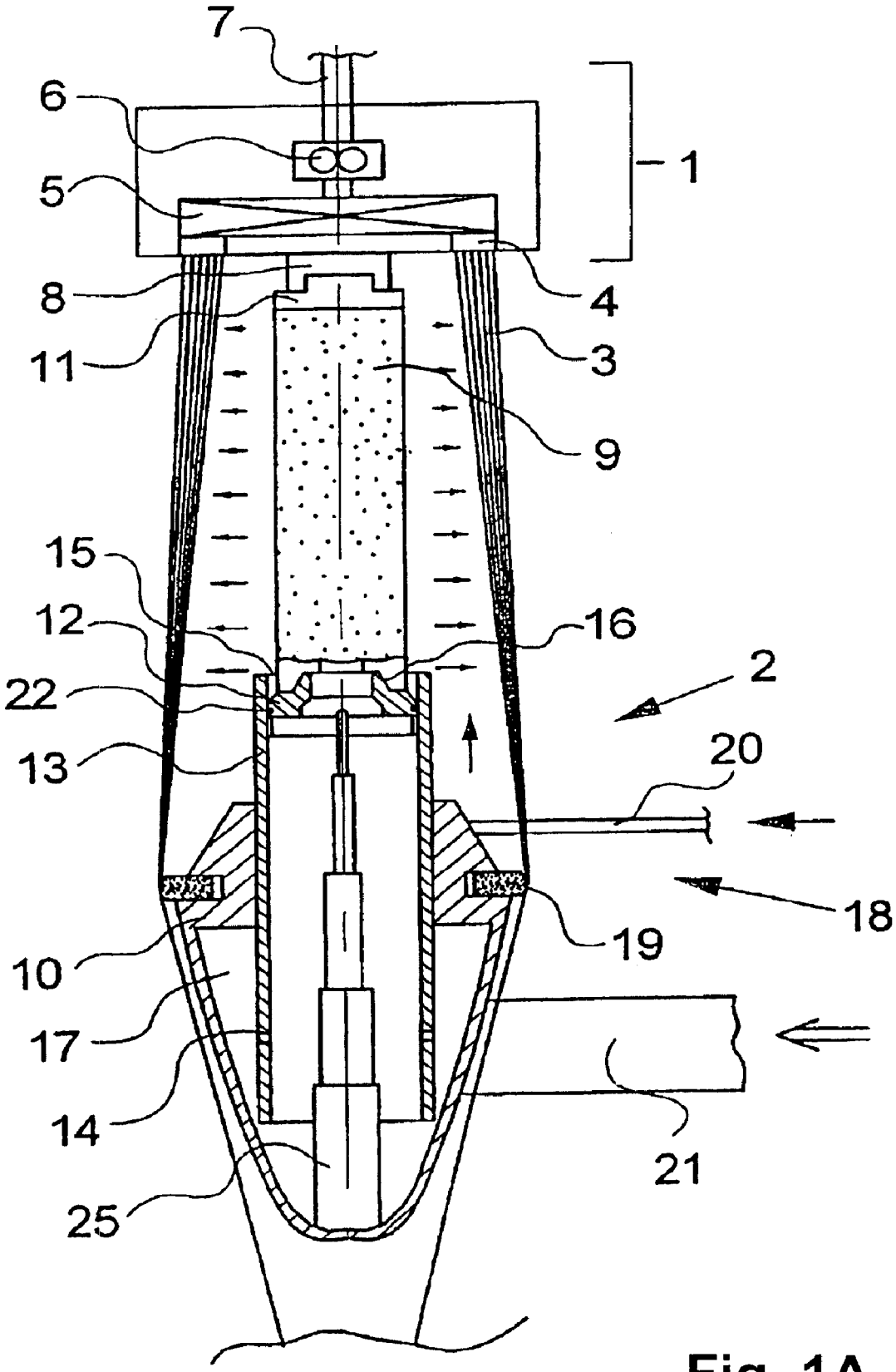
FIG. 1A is a schematic view of the apparatus when it is in operation, according to a first embodiment of the present invention.

Unless specific reference is made to one of the figures, the following description applies to both.

The invention comprises a spinning device 1 and a cooling device 2 arranged below the spinning device 1. On its underside spinning device 1 comprises an annular spinneret 4, which is connected with a spin pump 6 via a melt distributor 5. Spin pump 6 is connected with a melt generator (not depicted) via a melt line 7.

The cooling device 2 below spinning device 1 is provided with a holder 10 and a coolant dispersing head 9 that is connected with holder 10. The coolant dispersing head 9 has a porous shell, which can be made, for instance, of a nonwoven material, a foam, a wire gauze, or a sintered material. At its free end, the coolant dispersing head 9 is sealed by a centering shoulder 11. With its opposite end, coolant dispersing head 9 is guided in a guide tube 13 via a connecting piece 12. Connecting piece 12 and coolant dispersing head 9 are interconnected via a detachable conical seat 16.

Guide tube 13 is fixed to the holder 10 concentrically to the coolant dispersing head 9. The inside diameter of guide tube 13 is larger than the outside diameter of coolant dispersing head 9. One end of guide tube 13 protrudes from holder 10. This end of guide tube 13 is referred to as the blowing end and is identified by reference numeral 15. With its opposite end, guide tube 13 projects into a pressure chamber 17 which is formed in the interior of holder 10.

The cylindrical connecting piece 12 is slidingly guided within guide tube 13. In the guidance portion of connecting piece 12 a seal 22 is provided along the circumference relative to the wall of guide tube 13. Connecting piece 12 is configured as a hollow cylinder and is connected with pressure chamber 17 within holder 10 via the open end of guide tube 13. Pressure chamber 17 within holder 10 is connected with a pressure source via feed inlet 21.

Through the open end of guide tube 13, connecting piece 12 is connected with an actuator 25, which is preferably embodied as a piston-cylinder unit and is held within pressure chamber 17 on holder 10. Through actuator 25, the coolant dispersing head 9 can be moved between an operating position and a standby position and vice versa.

Along the circumference of holder 10, a finishing device 18 is provided, which comprises a finishing ring 19 mounted to holder 10. Finishing ring 19 is supplied with a finishing liquid from the inside, which is fed via a line 20.

FIG. 1A shows the apparatus in operation. For this purpose, the coolant dispersing head 9 is held in an operating position by actuator 25. The centering shoulder 11 of coolant dispersing head 9 rests against a limit stop 8 of spinning device 1. Limit stop 8 is arranged on the underside of spinning device 1 and is substantially centered relative to spinneret 4.

In the operating position, a cooling agent, preferably cooling air, is supplied via feed inlet 21 and a pressure chamber 17, which is formed within holder 10. Via pressure chamber 17, the coolant is guided into the interior of coolant dispersing head 9 via the open end of guide tube 13 and the hollow cylindrical connecting piece 12. The coolant now passes uniformly through the shell of coolant dispersing head 9 to the outside and penetrates a group of filaments 3 produced by spinneret 4 from the interior toward the exterior. After the filaments of filament group 3 have been cooled, they are finished in finishing device 18. For this purpose, a finishing agent is supplied to finishing ring 19 via line 20. This finishing ring 19 can be made, for instance, of a porous material, such that the finishing agent is uniformly distributed in finishing ring 19 and exits along the surface for finishing the filaments. After finishing, the filament bundle is ready for further processing. For instance, the group of filaments could be guided to form threads, which are wound up, or be combined into a thread bundle and deposited in a can.

Figure 1B:
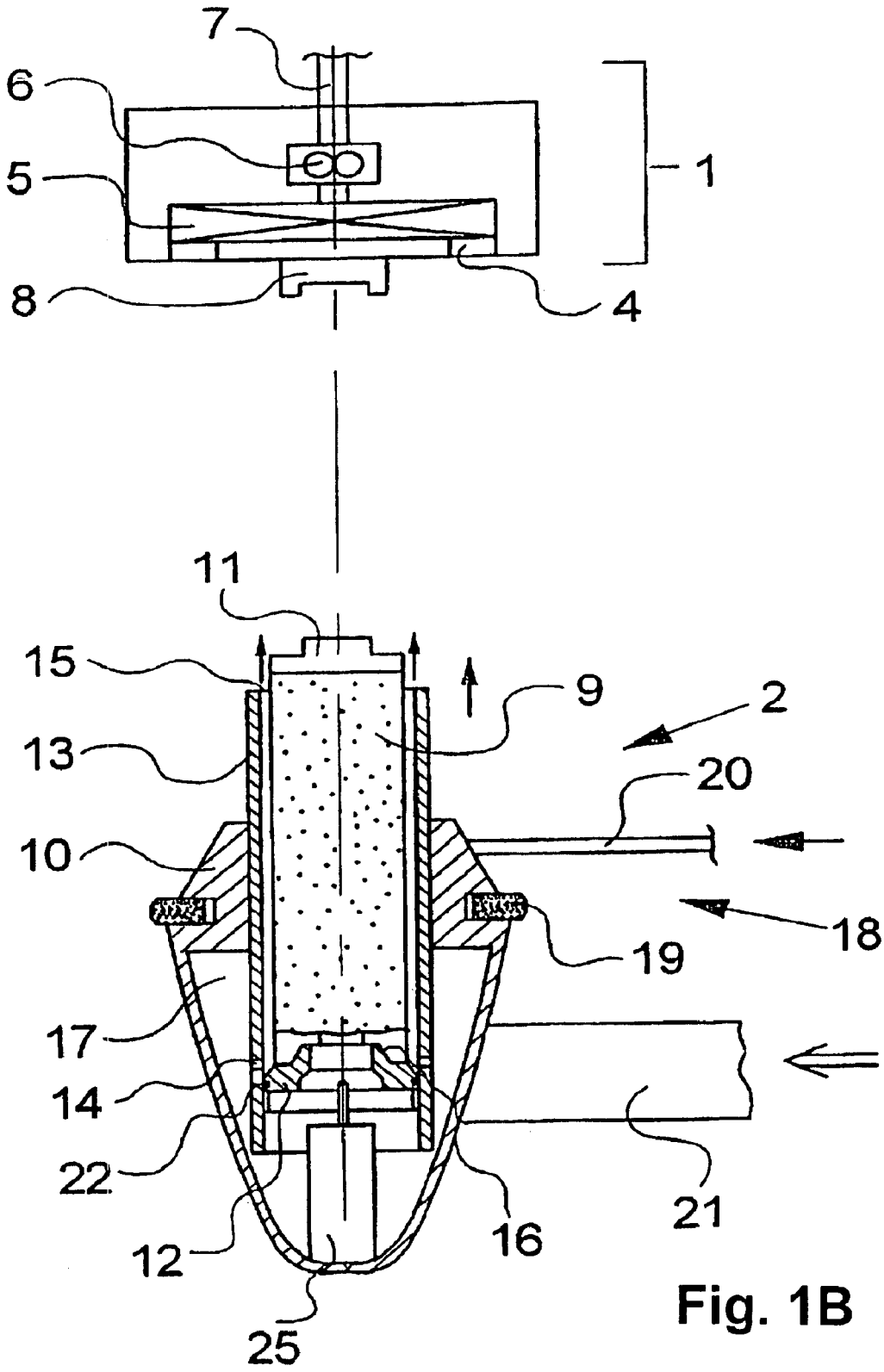
FIG. 1B is a schematic view of the apparatus when it is not in operation, according to the first embodiment of the present invention.

FIG. 1B depicts the inventive apparatus when it is not in operation. The coolant dispersing head 9 of cooling device 2 is in a standby position at a distance from spinneret 4. The coolant dispersing head 9 with connecting piece 12 is axially displaced in thread direction within guide tube 13 by actuator 25, such that the centering shoulder 11 of coolant dispersing head 9 is detached from limit stop 8 of spinning device 1. Coolant dispersing head 9 plunges into guide tube 13, such that guide tube 13 encloses at least a partial area of coolant dispersing head 9 in the form of a jacket.

In standby position, coolant dispersing head 9 can be easily detached from its conical seat 16, for instance to be replaced by a new coolant dispersing head. Advantageously, such a replacement can only be performed by an operator to minimize interruption of production due to coolant head replacement. At the same time, while the coolant dispersing head 9 is removed, the underside of spinneret 4 can be cleaned. Holder 10 of cooling device 2 can be kept stationary during this process. However, holder 10 can also be designed to be height adjustable and/or pivotable relative to spinning device 1. The height adjustability of holder 10 is particularly advantageous for setting the finishing position while the apparatus is in operation.

Only after any possible process disturbance has been eliminated, the process can be resumed by spinning startup. To return the coolant dispersing head 9 from its standby position to the operating position, a cooling air stream is supplied to coolant dispersing head 9 via pressure chamber 17. In the area of coolant dispersing head 9 which is covered by guide tube 13, the air stream exiting radially from the shell of coolant dispersing head 9 is taken up by guide tube 13 and is blown out through open blowing end 15 of guide tube 13 as a substantially axially directed air stream. The air stream flowing parallel to coolant dispersing head 9 is trained onto spinning device 1, so as to prevent filament strands from entering into the trajectory of coolant dispersing head 9. In addition, the radial air stream produced by coolant dispersing head 9 outside guide tube 13 acts on the filament curtain, so that any contact between coolant dispersing head 9 and the filament strands is excluded.

To increase the air stream exiting at blowing end 15, guide tube 13 can be provided with one or several lateral openings 14 in the area of pressure chamber 17 through which pressure chamber 17 directly communicates with the interior of guide tube 13 and directly reaches blowing end 15. In FIGS. 1A and 1B, lateral openings 14 are represented by dashed lines.

The connection between blowing end 15 and pressure chamber 17 is thus only given in the standby position of coolant dispersing head 9. In this position, connecting piece 12 with seal 22 is located directly at the open end of guide tube 13 below lateral opening 14. Only after coolant dispersing head 9 has been brought into its operating position, the connection between pressure chamber 17 and blowing end 15 is interrupted in pressure-tight manner by seal 22 which is provided along the circumference of connecting piece 12.

Figure 2:
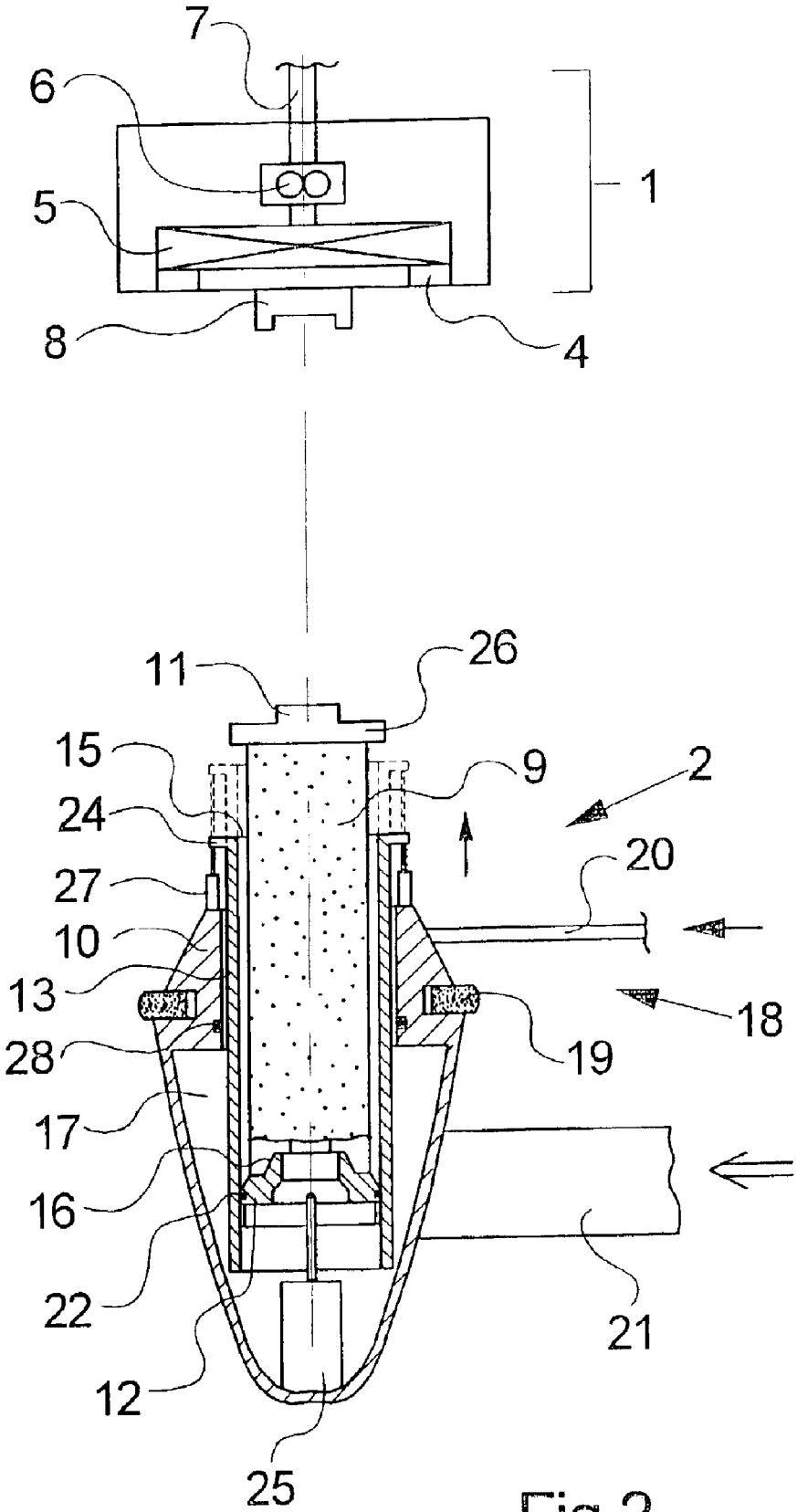
FIG. 2 is a schematic view of a second embodiment of the apparatus of the present invention.

FIG. 2 depicts a further embodiment of an apparatus according to the invention. The embodiment shown in FIG. 2 is substantially identical to that of the preceding embodiment, so that only the significant differences are described below. Components with like functions carry identical reference numerals.

The embodiment depicted in FIG. 2 is not in operation. Coolant dispersing head 9 is held on holder 10 in its standby position. Coolant dispersing head 9 is slidingly guided in guide tube 13 via connecting piece 12. The movement of coolant dispersing head 9 is controlled by actuator 25. Guide tube 13 is axially displaceable in holder 10. To this end, blowing end 15 of guide tube 13 is provided with one or several radially projecting webs 24 with which one or more actuators 27 engage. Actuator 27 is mounted on holder 10. Between the circumference of guide tube 13 and holder 10, a seal 28 is provided by means of which pressure chamber 17 is outwardly sealed.

Coolant dispersing head 9 held in guide tube 13 has a centering shoulder 11 at its free end. Centering shoulder 11 is provided with a circumferential collar 26 whose outside diameter is larger than the outside diameter of coolant dispersing head 9.

After spinning startup, cooling air is supplied to coolant dispersing head 9 via pressure chamber 17. Due to the areas of coolant dispersing head 9 that are covered by guide tube 13, the radially exiting air stream of coolant dispersing head 9 is diverted by guide tube 13 and guided to blowing end 15. The air stream exiting from blowing end 15 flows substantially parallel to coolant dispersing head 9 and is deflected in radial direction by collar 26 at the free end of coolant dispersing head 9, so that the filament curtain flares out.

To permit a partial air stream in axial direction, collar 26 of centering shoulder 11 can be provided with a plurality of openings, such that a portion of the air stream exiting from blowing end 15 of guide tube 13 flows axially against the spinning device.

To change the degree of overlap between guide tube 13 and coolant dispersing head 9 in the standby position, guide tube 13 can be displaced by actuator 27 in the direction toward the free end of coolant dispersing head 9. This enlarges the degree of overlap, such that a stronger air stream can be produced at the blowing end 15.

In addition, a circumferential gap can be formed between blowing end 15 of guide tube 13 and collar 26 to generate a radially directed air stream.

After coolant dispersing head 9 has reached its operating position below spinning device 1, guide tube 13 is returned to a lower position by actuator 27, such that there is no overlap between guide tube 13 and coolant dispersing head 1. This causes coolant dispersing head 9 to be axially moved within guide tube 13 via connecting piece 12 and actuator 25.

The embodiments shown in FIGS. 1A and 2B are given by way of example with respect to their construction and their type. The invention extends not only to the exemplary embodiments shown here but comprises any cooling device with which a person skilled in the art will be familiar and in which a relative motion can be executed between the coolant dispersing head and the holder in order to adjust the coolant dispersing head between an operating position and a standby position.

What is claimed is:

1. A device for melt spinning and cooling a group of filaments comprising:

a spinning device comprising an annular spinneret for extruding the group of filaments;

a cooling device arranged below the spinning device, the cooling device comprising a holder and a coolant dispersing head connected to the holder; and a guide tube that encloses the coolant dispersing head in the form of a jacket with a clearance;

wherein the coolant dispersing head is substantially centered relative to the spinneret such that the coolant dispersing head has contact with the spinning device in an operating position;

wherein the coolant dispersing head can be guided into a standby position below the spinneret;

wherein the guide tube is open at its end facing toward the spinning device (blowing end); and wherein the guide tube and the coolant dispersing head can be displaced relative to one another in axial direction to produce an air stream at the blowing end of the guide tube.

2. The device as claimed in claim 1 wherein the guide tube is mounted to the holder and the coolant dispersing head can be axially moved relative to the holder between the operating position and the standby position, and wherein no overlap exists between the guide tube and the coolant dispersing head in the operating position.

3. The device as claimed in claim 2, wherein the guide tube is axially movable on the holder to adjust the degree of overlap on the coolant dispersing head.

4. The device as claimed in claim 1, wherein the coolant dispersing head has a centering shoulder at its free end with a circumferential collar that protrudes over the coolant dispersing head.

5. The device as claimed in claim 1, wherein the coolant dispersing head at its end facing the holder is provided with a connecting piece that is sealingly guided in the guide tube.

6. The device as claimed in claim 5, wherein the end of the guide tube that is opposite of the blowing end communicates with a pressure chamber.

7. The device as claimed in claim 6, wherein a plurality of lateral openings is provided along the circumference of the guide tube such that the blowing end of the guide tube communicates with the pressure chamber.

8. The device as claimed in claim 7, wherein, in the operating position of the coolant dispersing head, the connection between the lateral openings and the blowing end of the guide tube is interrupted by the connecting piece.

9. The device as claimed in claim 1, wherein the holder comprises a controllable actuator that axially adjusts the coolant dispersing head relative to the holder between the operating position and the standby position, and clamps the coolant dispersing head between the holder and the spinning device.

10. The device as claimed in claim 1, wherein the coolant dispersing head and the holder are detachably interconnected such that the coolant dispersing head can be replaced in the standby position.

11. The device as claimed in claim 1, wherein below the coolant dispersing head, the holder carries a finishing device, which comprises a finishing ring that is contacted by the group of filaments.

12. The device as claimed in claim 11, wherein the finishing ring is formed by a plurality of ceramic disks.

13. The device as claimed in claim 1, wherein the holder is pivotable relative to the spinning device.

* * * * *

UNITED STATES PATENT AND TRADEMARK OFFICE

CERTIFICATE OF CORRECTION

PATENT NO. : 6,902,384 B2
DATED : June 7, 2005
INVENTOR(S) : Horst Kropat et al.

It is certified that error appears in the above-identified patent and that said Letters Patent is hereby corrected as shown below:

Column 6,
Line 34, "FIGS. 1A and 2B" should read -- FIGS. 1A, 1B, and 2 --.

Signed and Sealed this

Eleventh Day of October, 2005

JON W. DUDAS
*Director of the United States Patent and Trademark Office*